US007841304B2

(12) United States Patent
Van Wees et al.

(10) Patent No.: US 7,841,304 B2
(45) Date of Patent: Nov. 30, 2010

(54) APPARATUS FOR STEAM HEAT RECOVERY FROM MULTIPLE HEAT STREAMS

(75) Inventors: Mark Van Wees, Des Plaines, IL (US); Jason L. Stahlman, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 400 days.

(21) Appl. No.: 11/752,509

(22) Filed: May 23, 2007

(65) Prior Publication Data

US 2008/0289589 A1 Nov. 27, 2008

(51) Int. Cl.
*F22B 37/26* (2006.01)

(52) U.S. Cl. ..... 122/7 R; 122/492

(58) Field of Classification Search ..... 122/412, 122/414, 7 R, 492, 406.1, 406.2, 406.3, 459
See application file for complete search history.

(56) References Cited

U.S. PATENT DOCUMENTS 2,089,915 A * 8/1937 Gilli ..... 122/35
4,257,579 A 3/1981 Bruhn et al. ..... 266/141
4,340,207 A 7/1982 Bruhn et al. ..... 266/155
4,377,066 A * 3/1983 Dickinson ..... 60/775
4,445,461 A * 5/1984 Farnia ..... 122/7 R
4,484,531 A * 11/1984 Firey ..... 110/342
4,573,323 A * 3/1986 Mock ..... 60/665
6,401,667 B2 * 6/2002 Liebig ..... 122/7 R
6,427,636 B1 * 8/2002 Liebig ..... 122/1 R
6,434,925 B2 8/2002 Hannemann et al. ..... 60/39.12
6,588,379 B2 * 7/2003 Bingham et al. ..... 122/235.16
6,966,190 B2 11/2005 Wylie ..... 60/780
2008/0038185 A1 * 2/2008 Freitag et al. ..... 423/580.1

* cited by examiner

*Primary Examiner*—Gregory A Wilson
(74) *Attorney, Agent, or Firm*—James C. Paschall

(57) ABSTRACT

Disclosed is an apparatus and process for recovering heat from multiple hot process streams without multiplying instrumentation. Each hot process stream is indirectly heat exchanged with a water circuit which leaves and feeds a steam drum. Heat is added to the steam drum through the addition of water heated outside of the steam drum. The heated liquid and vapor water is heated in heat exchangers decoupled from the steam drum. The water circuits are arranged in parallel with each other and feed a single steam drum to provide a steam product of a desired pressure for which only one set of instrumentation is needed.

20 Claims, 1 Drawing Sheet

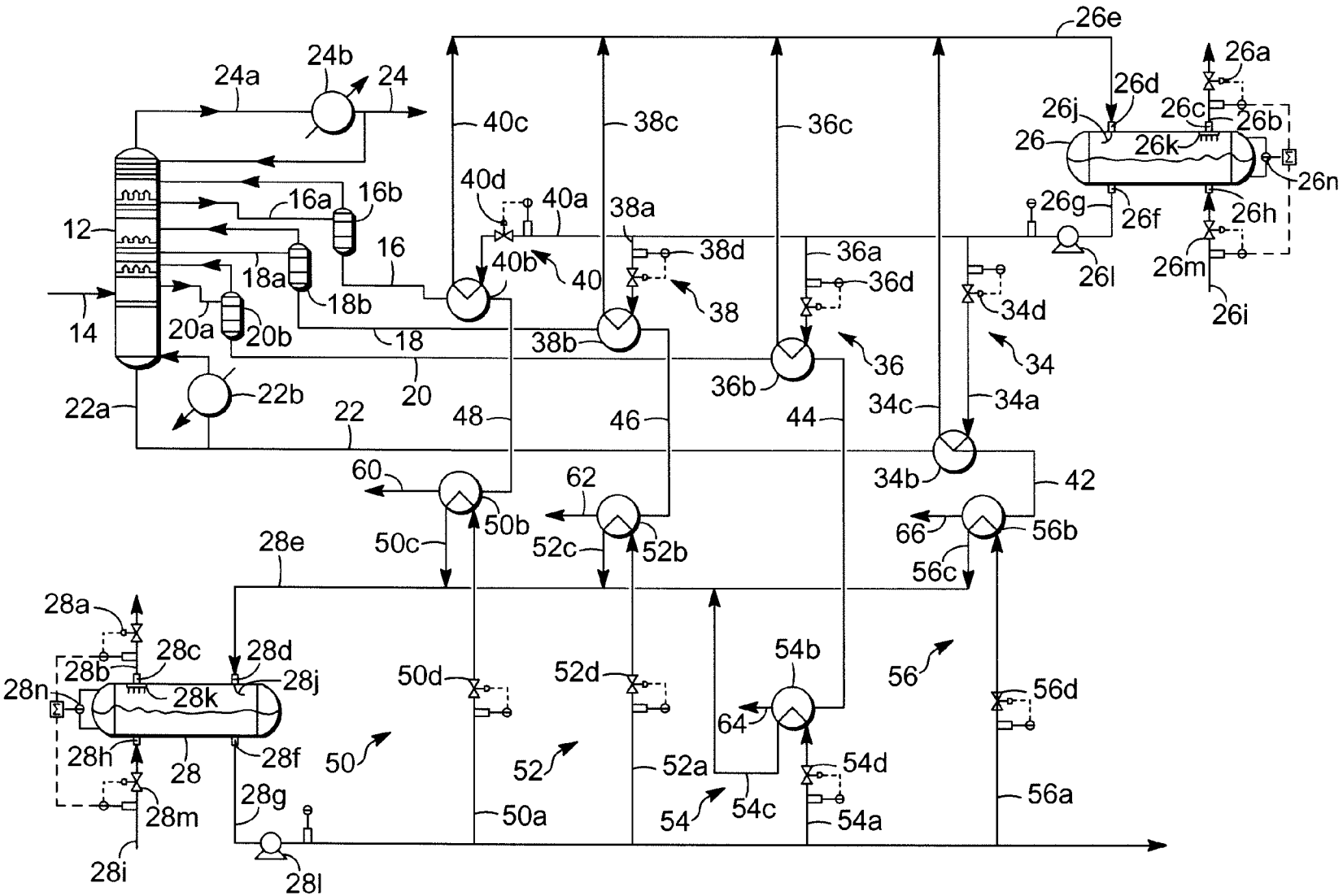
26a
26b
26n
26c
26h
26i
26m
26k
26d
26f
26e
26j
26g
26l
26
34d
34
34a
42
56b
56d
56a
34c
34b
66
56c
56
36a
36d
36
44
54d
54a
36c
36b
54b
64
54c
38d
38
52a
54
38c
38a
46
52b
52d
62
52c
52
40a
40
40b
40c
40d
48
50b
50a
50d
50c
60
50
24
16b
16
18
20
24b
18b
22
16a
18a
20b
22b
28e
28j
28l
28d
28f
28g
24a
20a
28k
28
28c
28m
12
14
22a
28a
28b
28h
28i
28n

APPARATUS FOR STEAM HEAT RECOVERY FROM MULTIPLE HEAT STREAMS

FIELD OF THE INVENTION

The field of the invention is heat recovery in a process plant.

BACKGROUND OF THE INVENTION

Generating steam from hot process streams is a common method for recovering low value heat particularly in a petroleum refinery. Steam is generated by indirectly heat exchanging the hot process stream with water in a kettle steam generator. A kettle steam generator typically comprises a cylindrical shell and tube heat exchanger with the hot process stream circulating inside the tube bundle and water in the shell. Heat is indirectly transferred from the hot process stream to vaporize the water.

Steam quality is categorized by pressure level. Low pressure steam is typically generated at 241-448 kPa (gauge) (35-65 psig). Medium pressure steam is typically generated at 862-1207 kPa (gauge) (125-175 psig) and high pressure steam is typically generated at or greater than about 4137 kPa (gauge) (600 psig).

The economics of the typical kettle steam generator often do not justify installation, especially as the quantity of recoverable heat is reduced. The expense of kettle steam generators is due in large part to the quantity of instrumentation that is required for each kettle steam generator. Piping, vessels and other auxiliary systems also add cost to the installation. Each steam kettle is typically equipped with a boiler feedwater inlet, a steam outlet, at least two drainage outlets for removing precipitates and at least one steam vent for over pressure relief all with necessary piping and valving. Additionally, instrumentation is required to monitor the water level in the kettle and the steam flow rate through the steam outlet leaving the kettle to regulate with further instrumentation the flow rate of boiler feedwater into the kettle. Installation costs multiply for recovering heat from each additional process stream.

To improve the economics of installing steam kettle generators for heat recovery from multiple process streams it has been proposed to put two discrete heat exchanger tube bundles into a single kettle steam generator thus halving the required instrumentation. Each tube bundle carries a single hot process stream for indirect heat exchange with the water in the kettle. However, the physical installation of this design is cumbersome because tube bundles enter both ends of the cylindrical kettle, thus obstructing access to the interior of the kettle from the traditional location at one end.

SUMMARY OF THE INVENTION

We have discovered an economical way of recovering heat from multiple hot process streams without multiplying instrumentation. Each hot process stream is indirectly heat exchanged with a water circuit which leaves and feeds a steam drum. Heat streams are not necessarily heat exchanged in the steam drum. Heat is added to the steam drum through the addition of water heated outside of the steam drum. The heated water is heated in heat exchangers decoupled from the steam drum. The water circuits are arranged in parallel with each other and feed a single steam drum to provide a steam product of a desired pressure for which only one set of instrumentation is needed.

BRIEF DESCRIPTION OF THE DRAWING

The FIGURE provides a schematical view of a flow scheme of the present invention.

DETAILED DESCRIPTION OF THE DRAWING

The invention allows any number of heat streams to generate steam in one steam drum. The invention can be exemplarily shown with reference to a hydrocracking fractionation column for separating products in an effluent from a hydrocracking reactor. However, the invention can be useful with any system in which multiple hot streams are available for generation of steam. For example, a typical hydrocracking fractionation section, there may be seven hot streams: three side product streams, one bottom product stream and three pump-around steams for cooling the column. A process unit 12 such as a fractionation column is shown in the FIGURE omitting the pump-arounds for the sake of simplicity. Hydrocracked effluent is fed to the fractionation column in line 14. Side cut streams 16*a*, 18*a* and 20*a* are steam stripped in stripper vessels 16*b*, 18*b* and 20*b* to produce side product streams 16, 18 and 20, respectively, while a portion of the side cut stream is returned to the column 14. A bottoms product 22*a* is removed from the bottom of the column, while a portion is reboiled in reboiler 22*b* and returned to the column while leaving bottoms product stream 22. In the case of all of the streams 16*a*-22*a* from the column 12, steam stripping or reboiling may be applicable. An overhead stream 24*a* is removed from the top of the column, condensed in cooler 24*b* by heat exchange, while a portion of overhead product is recovered in line 24 and the remaining portion is returned to the column.

Two steam drums 26 and 28 are shown in the FIGURE. Steam drum 26 has an optional control valve 26*a* set for emitting medium pressure steam through steam outlet line 26*b* from steam outlet 26*c*. Steam drum 28 has an optional control valve 28*a* set for emitting low pressure steam in steam line 28*b* from steam outlet 28*c*. It is also anticipated that additional steam drums could be utilized to produce steams at other pressures. Steam drums 26 and 28 each have a heated water inlet 26*d*, 28*d* which may terminate in a distributor 26*j*, 28*j* that directs incoming hot water and steam against an end of the steam drum 26, 28, respectively. A heated water conduit or line 26*e*, 28*e* is in communication with and carries heated liquid and vapor water to the heated water inlet 26*d*, 28*d*, respectively. Steam drums 26, 28 also have a drum water outlet 26*f*, 28*f* for removing liquid water carried in drum water line or conduit 26*g*, 28*g* from the steam drum 26, 28, respectively. The drum water line or conduit 26*g*, 28*g* communicates with the drum water outlet 26*f*, 28*f*, respectively. A feedwater inlet 26*h*, 28*h* admits boiler feedwater into the steam drum 26, 28 from feedwater line 26*i*, 28*i*, respectively.

Water carried in the drum water conduit 26*g* may be pumped through a pump 26*l* and is directed to a series of heat exchange circuits 34, 36, 38 and 40 connected between the drum water conduit 26*g* and the heated water conduit 26*e* in parallel. In the first heat exchange circuit 34, a first heat exchange inlet conduit 34*a* in communication with the drum water conduit 26*g* carries water from the drum water conduit to a first heat exchanger 34*b* in communication with the first heat exchange inlet conduit 34*a*. In heat exchanger 34*b*, water in the first heat exchange inlet conduit 34*a* is heated by indirect heat exchange with the hot first bottoms product in first bottoms product stream in line 22. The cooled first bottoms product stream exiting the heat exchanger 34*b* is directed in a transfer line 42. A first heat exchange outlet conduit 34*c* in communication with the first heat exchanger 34*b* carries heated water from the first heat exchanger 34*b*. The first heat exchange outlet conduit 34*c* in communication with the heated water conduit 26*e* carries heated water from the first heat exchange outlet conduit 34*c* to the heated water conduit 26*e*. Consequently, a first portion of drum water in the steam drum 26 is passed to a first heat exchange circuit 34 via conduits 26*g* and 34*a*. The first portion of drum water is indirectly heat exchanged in the first heat exchanger 34*b* with the first product bottoms stream to generate steam. The steam and heated water are passed from the first heat exchanger 34*b* to the steam drum 26 via conduits 34*c* and 26*e*. In the second heat exchange circuit 36, second heat exchange inlet conduit 36*a* in communication with the drum water conduit 26*g* carries water from the drum water conduit to a second heat exchanger 36*b* in communication with the first heat exchange inlet conduit 36*a*. In heat exchanger 36*b*, water in the second heat exchange inlet conduit 36*a* is heated by indirect heat exchange with a hot second product stream in second product line 20. The cooled second product stream exiting the heat exchanger 36*b* is directed in a transfer line 44. A second heat exchange outlet conduit 36*c* in communication with the second heat exchanger 36*b* carries heated water from the second heat exchanger 36*b*. The second heat exchange outlet conduit 36*c* in communication with the heated water conduit 26*e* carries heated water from the second heat exchange outlet conduit 36*c* to the heated water conduit 26*e*. Consequently, a second portion of drum water in the steam drum 26 is passed to a second heat exchange circuit 36 via conduits 26*g* and 36*a*. The second portion of drum water is indirectly heat exchanged in the second heat exchanger 36*b* with the second product stream to generate steam. The steam and heated water are passed from the second heat exchanger 36*b* to the steam drum 26 via conduits 36*c* and 26*e*. In the third heat exchange circuit 38, a third heat exchange inlet conduit 38*a* in communication with the drum water conduit 26*g* carries water from the drum water conduit to a third heat exchanger 38*b* in communication with the third heat exchange inlet conduit 38*a*. In heat exchanger 38*b*, water in the third heat exchange inlet conduit 38*a* is heated by indirect heat exchange with a hot third product stream in third product line 18. The cooled third product stream exiting the heat exchanger 38*b* is directed in a transfer line 46. A third heat exchange outlet conduit 38*c* in communication with the third heat exchanger 38*b* carries heated water from the third heat exchanger 38*b*. The third heat exchange outlet conduit 38*c* in communication with the heated water conduit 26*e* carries heated water from the third heat exchange outlet conduit 38*c* to the heated water conduit 26*e*. Consequently, a third portion of drum water in the steam drum 26 is passed to a third heat exchange circuit 38 via conduits 26*g* and 38*a*. The third portion of drum water is indirectly heat exchanged in the third heat exchanger 38*b* with the third product stream to generate steam. The steam and heated water are passed from the third heat exchanger 38*b* to the steam drum 26 via conduits 38*c* and 26*e*. In the fourth heat exchange circuit 40, a fourth heat exchange inlet conduit 40*a* in communication with the drum water conduit 26*g* carries water from the drum water conduit to a fourth heat exchanger 40*b* in communication with the fourth heat exchange inlet conduit 40*a*. In heat exchanger 40*b*, water in fourth heat exchange inlet conduit 40*a* is heated by indirect heat exchange with the hot fourth product stream in fourth product stream line 16. The cooled fourth product stream exiting the heat exchanger 40*b* is directed in a transfer line 48. A fourth heat exchange outlet conduit 40*c* in communication with the fourth heat exchanger 40*b* carries heated water from the fourth heat exchanger 40*b*. The fourth heat exchange outlet conduit 40*c* in communication with the heated water conduit 26*e* carries heated water from the fourth heat exchange outlet conduit 40*c* to the heated water conduit 26*e*. Consequently, a fourth portion of drum water in the steam drum 26 is passed to a third heat exchange circuit 40 via conduits 26*g* and 40*a*. The fourth portion of drum water is indirectly heat exchanged in the fourth heat exchanger 40*b* with the fourth product stream to generate steam. The steam and heated water are passed from the fourth heat exchanger 40*b* to said steam drum 26 via conduits 40*c* and 26*e*. The heat exchange outlet conduits 34*c*, 36*c*, 38*c* and 40*c* all communicate with the heated water conduit 26*e* in parallel which provides heated water and steam to the steam drum 26. The heated water which is a mixture of liquid and vapor water separates upon entering the steam drum 26 to provide steam and liquid water. Medium pressure steam is then supplied in steam outlet conduit or line 26*b* in communication with the steam outlet 26*c*.

Turning to the second steam drum 28, water carried in the drum water conduit 28*g* may be pumped through a pump 28*l* and is directed to a series of heat exchange circuits 50, 52, 54, 56 connected between the drum water conduit 28*g* and the heated water conduit 28*e* in parallel. In the first heat exchange circuit 50, a first heat exchange inlet conduit 50*a* in communication with the drum water conduit 28*g* carries water from the drum water conduit to a first heat exchanger 50*b* in communication with the first heat exchange inlet conduit 50*a*. In heat exchanger 50*b*, water in the first heat exchange inlet conduit 50*a* is heated by indirect heat exchange with the cooled first bottoms product in first transfer line 48. The twice cooled first bottoms product stream exiting the heat exchanger 50*b* is recovered in a first product recovery line 60. A first heat exchange outlet conduit 50*c* in communication with the first heat exchanger 50*b* carries heated water from the first heat exchanger 50*b*. The first heat exchange outlet conduit 50*c* in communication with the heated water conduit 28*e* carries heated water from the first heat exchange outlet conduit 50*c* to the heated water conduit 28*e*. In the second heat exchange circuit 52, a second heat exchange inlet conduit 52*a* in communication with the drum water conduit 28*g* carries water from the drum water conduit to a second heat exchanger 52*b* in communication with the second heat exchange inlet conduit 52*a*. In heat exchanger 52*b*, water in the second heat exchange inlet conduit 52*a* is heated by indirect heat exchange with a cooled second product stream in a second transfer line 46. The twice cooled second product stream exiting the heat exchanger 52*b* is directed in a second product recovery line 62. A second heat exchange outlet conduit 52*c* in communication with the second heat exchanger 52*b* carries heated water from the second heat exchanger 52*b*. The second heat exchange outlet conduit 52*c* in communication with the heated water conduit 28*e* carries heated water from the second heat exchange outlet conduit 52*c* to the heated water conduit 28*e*. In the third heat exchange circuit 54, a third heat exchange inlet conduit 54*a* in communication with the drum water conduit 28*g* carries water from the drum water conduit to a third heat exchanger 54*b* in communication with the third heat exchange inlet conduit 54*a*. In heat exchanger 54*b*, water in the third heat exchange inlet conduit 54*a* is heated by indirect heat exchange with a cooled third product stream in third transfer line 44. The twice cooled third product stream exiting the heat exchanger 54*b* is directed in a third product recovery line 64. A third heat exchange outlet conduit 54*c* in communication with the third heat exchanger 54*b* carries heated water from the third heat exchanger 54*b*. The third heat exchange outlet conduit 54*c* in communication with the heated water conduit 28*e* carries heated water from the third heat exchange outlet conduit 54*c* to the heated water conduit 28*e*. In a fourth heat exchange circuit 56, a fourth heat exchange inlet conduit 56*a* in communication with the drum water conduit 28*g* carries water from the drum water conduit to a fourth heat exchanger 56*b* in communication with the fourth heat exchange inlet conduit 56*a*. In the fourth heat exchanger 56*b*, water in the fourth heat exchange inlet conduit 56*a* is heated by indirect heat exchange with the cooled fourth product stream in fourth transfer line 42. The twice cooled fourth product stream exiting the heat exchanger 56*b* is directed in a fourth product recovery line 66. A fourth heat exchange outlet conduit 56*c* in communication with the fourth heat exchanger 56*b* carries heated water from the fourth heat exchanger 56*b*. The fourth heat exchange outlet conduit 56*c* in communication with the heated water conduit 28*e* carries heated water from the fourth heat exchange outlet conduit 56*c* to the heated water conduit 28*e*. The heat exchange outlet conduits 50*c*, 52*c*, 54*c* and 56*c* all communicate with the heated water conduit 28*e* in parallel which provides steam to the steam drum 28. The heated mixture of liquid and vapor water separates upon entering steam drum 28 to provide steam and liquid water. Low pressure steam is then supplied in steam outlet conduit or line 28*b* in communication with the steam outlet 28*c*.

The hot process streams taken from the process unit 12 may be heat exchanged with water streams from more than one steam drum. A first hot bottoms product stream 22 is transported to a first heat exchanger 34*b* via conduit 22. The first hot bottoms product stream in conduit 22 is indirectly heat exchanged with a first drum water stream from the first steam drum 26 via conduits 26*g* and 34*a* in the first heat exchanger 34*b*. Steam and heated water from the first heat exchanger 34*b* are passed to the first steam drum 26 via conduits 34*c* and 26*e*. A first cooled hot bottoms product stream is passed from the first heat exchanger 34*b* to heat exchanger 56*b* via conduit 42. The first, cooled hot bottoms product stream is indirectly heat exchanged with a second drum water stream from the second steam drum 28 via conduits 28*g* and 56*a* in the heat exchanger 56*c*. Steam and heated water are passed from the heat exchanger 56*b* to the second steam drum 28 via conduits 56*c* and 28*e*. Steam is recovered from the first steam drum 26 and the second steam drum 28, and a first, twice cooled hot product stream is recovered from the heat exchanger 56*b* in conduit 66. A second hot product stream is transported to a second heat exchanger 36*b* via conduit 20. The second hot product stream in conduit 22 is indirectly heat exchanged with a third drum water stream from the first steam drum 26 via conduits 26*g* and 36*a* in the second heat exchanger 36*b*. Steam and heated water from the second heat exchanger 36*b* are passed to the first steam drum 26 via conduits 36*c* and 26*e*. A second, cooled hot product stream is passed from the second heat exchanger 36*b* to heat exchanger 54*b* via conduit 44. The second, cooled hot product stream is indirectly heat exchanged with a fourth drum water stream from the second steam drum 28 via conduits 28*g* and 54*a* in the heat exchanger 54*b*. Steam and heated water are passed from the heat exchanger 54*b* to the second steam drum 28 via conduits 54*c* and 28*e*. Steam is recovered from the first steam drum 26 and the second steam drum 28, and a second, twice cooled hot product stream is recovered from the heat exchanger 54*b* in conduit 64. The hot product streams 16 and 18 and other hot streams from the process unit 12 may be similarly cooled to generate steam.

A steam separator 26*k*, 28*k* interposed between an interior volume of the steam drum 26, 28 and steam outlet conduit 26*b*, 28*b* prevents liquid droplets from exiting with the steam. Although shown in the interior volume of the steam drum 26, 28, the steam separator may be disposed outside of the steam drum 26, 28. The liquid water level in the steam drum 26, 28 may be monitored by a level indicator controller 26*n*, 28*n*, respectively. The steam flow rate out of the drum 26, 28 through the steam outlet conduit 26*b*, 28*b* and the water flow rate into the drum 26, 28 through the feedwater conduit 26*i*, 28*i* may be monitored by a flow indicator. Based on these indications, a control valve 26*m*, 28*m* may regulate the flow rate of water into the steam drum 26, 28 through the boiler feedwater inlet conduit 26*i*,28*i*, respectively. Other accoutrements of the steam drum 26, 28 such as vents and drains are not shown for simplicity. Control valves 34*d*, 36*d*, 38*d*, 40*d*, 50*d*, 52*d*, 54*d* and 56*d* regulate water flow through heat exchange inlet and outlet conduits when pumps 26*l*, 28*l* are used.

The FIGURE shows four heat exchange circuits feeding each steam drum, but at least only two is necessary. At least three heat exchange circuits is preferable and more than four heat exchange circuits may also be advantageous.

The invention reduces instrumentation and piping requirements for steam generation at each pressure level. The equipment layout is also greatly simplified. The unshown continuous and intermittent blow down lines freely drain to respective blowdown drums. Fewer steam drums need to be located near each other to drain into the common blowdown drums allowing greater flexibility in the placement of the steam drums and heat exchangers. An additional benefit is the steam produced from a steam drum is a better quality than steam produced from kettle steam generators. Kettle steam generators are not typically provided with a steam separator due to various size constraints. The steam drum inherent in the proposed design allows easy economical installation of a steam separator 26*k*, 28*k* which will improve steam quality and purity.

The invention claimed is:

1. An apparatus for generating steam comprising:

a steam drum having a heated water inlet, a drum water outlet and a steam outlet;

a heated water conduit in communication with said heated water inlet; said heated water conduit for carrying heated liquid and vapor water to said heated water inlet;

a drum water conduit in communication with said drum water outlet for carrying water from said steam drum;

a first heat exchange inlet conduit in communication with the drum water conduit for carrying water from said drum water conduit;

a first heat exchanger in communication with said first heat exchange inlet conduit for heating the water from said drum water conduit;

a first hot petroleum process stream conduit in communication with said first heat exchanger for carrying a first hot petroleum process stream and indirectly transferring heat to the water in said first heat exchanger;

a first heat exchange outlet conduit in communication with said first heat exchanger for carrying heated water from said first heat exchanger; said first heat exchange outlet conduit in communication with said heated water conduit for carrying heated water from said first heat exchange outlet conduit;

a second heat exchange inlet conduit in communication with the drum water conduit for carrying water from said drum water conduit;

a second heat exchanger in communication with said second heat exchange inlet conduit for heating the water from said drum water conduit;

a second hot petroleum process stream conduit in communication with said second heat exchanger for carrying a second hot petroleum process stream and indirectly transferring heat to the water in said second heat exchanger;

a second heat exchange outlet conduit in communication with said second heat exchanger for carrying heated water from said second heat exchanger; said second heat exchange outlet conduit in communication with said heated water conduit for carrying heated water from said second heat exchange outlet conduit; and a steam outlet conduit in communication with said steam outlet for carrying steam from said steam drum.

2. The apparatus for generating steam of claim 1 further comprising a boiler feedwater inlet to said steam drum for carrying boiler feedwater to said steam drum.

3. The apparatus for generating steam of claim 2 further comprising a control valve on the feedwater inlet conduit for controlling the flow rate of water into said steam drum through said boiler feedwater inlet.

4. The apparatus for generating steam of claim 3 in which the control valve on the feedwater inlet conduit is set based on indications from a level indicator controller that monitors the liquid water level in the steam drum and a flow indicator controller that monitors the flow rate of steam out of the steam drum.

5. The apparatus for generating steam of claim 1 further comprising a distributor in communication with said heated water inlet for distributing heated water into said steam drum.

6. The apparatus for generating steam of claim 1 further comprising a steam separator in communication with said steam outlet for preventing liquid water from leaving through said steam outlet conduit.

7. The apparatus for generating steam of claim 1 further comprising a pump in communication with said drum water conduit.

8. The apparatus for generating steam of claim 1 further comprising a control valve for regulating the flow rate of water through said first heat exchange inlet conduit.

9. An apparatus for generating steam comprising:

a steam drum having a heated water inlet, a drum water outlet and a steam outlet;

a heated water conduit in communication with said heated water inlet; said heated water conduit for carrying heated vapor and liquid water to said heated water inlet;

a drum water conduit in communication with said drum water outlet for carrying water from said steam drum;

a first heat exchange circuit in communication with said drum water conduit for indirectly heat exchanging a first hot petroleum process stream in a first hot petroleum process stream conduit with water from said drum water conduit in a first heat exchanger and returning heated water from said first heat exchanger to said heated water conduit;

a second heat exchange circuit in communication with said drum water conduit for indirectly heat exchanging a second hot petroleum process stream from a second hot petroleum process stream conduit with water from said drum water conduit in a second heat exchanger and returning heated water from said second heat exchanger to said heated water conduit; and a steam outlet conduit in communication with said steam outlet for carrying steam from said steam drum.

10. The apparatus for generating steam of claim 9 wherein said first heat exchange circuit comprises:

a first heat exchange inlet conduit in communication with the drum water conduit for carrying water from said drum water conduit;

said first heat exchanger in communication with said first heat exchange inlet conduit for heating the water from said drum water conduit;

said first hot petroleum process stream conduit in communication with said first heat exchanger for carrying said first hot petroleum process stream and indirectly transferring heat to the water in said first heat exchanger; and a first heat exchange outlet conduit in communication with said first heat exchanger for carrying heated water from said first heat exchanger to said heated water conduit.

11. The apparatus for generating steam of claim 9 further comprising a boiler feedwater inlet to said steam drum for carrying boiler feedwater to said steam drum.

12. The apparatus for generating steam of claim 11 further comprising a control valve on the boiler feedwater inlet conduit for controlling the flow rate of water into said steam drum through said boiler feedwater inlet.

13. The apparatus for generating steam of claim 12 in which the control valve on the feedwater inlet conduit is set based on indications from a level indicator controller that monitors the liquid water level in the steam drum and a flow indicator controller that monitors the flow rate of steam out of the steam drum.

14. The apparatus for generating steam of claim 9 further comprising a distributor in communication with said heated water inlet for distributing heated water into said steam drum.

15. The apparatus for generating steam of claim 9 further comprising a steam separator in communication with said steam outlet for preventing liquid water from leaving through said steam outlet conduit.

16. The apparatus for generating steam of claim 9 further comprising a pump in communication with said drum water conduit.

17. The apparatus for generating steam of claim 9 further comprising a control valve for regulating the flow rate of water through said first heat exchange inlet conduit.

18. An apparatus for generating steam comprising:

a steam drum having a heated water inlet, a drum water outlet and a steam outlet;

at least two heat exchange circuits in parallel communication with said heated water inlet and said drum water outlet; and each heat exchange circuit including an inlet conduit, an outlet conduit and a heat exchanger; said inlet conduit in communication with said drum water outlet and said heat exchanger, said heat exchanger for indirectly heat exchanging a hot petroleum process stream with water from said drum water outlet and said outlet conduit in communication with said heat exchanger and said heated water inlet wherein each heat exchange circuit is heat exchanged with a separate hot petroleum process stream.

19. The apparatus of claim 18 including at least three heat exchange circuits.

20. The apparatus of claim 18 wherein a drum water conduit is in communication with said drum water outlet and inlet conduits of said at least two heat exchange circuits and a heated water conduit is in communication with said heated water inlet and said outlet conduits of said at least two heat exchange circuits.

* * * * *